United States Patent [19]

Tarng

[11] Patent Number: 5,065,881

[45] Date of Patent: Nov. 19, 1991

[54] TANGS DRINKING CAN AND CAP

[76] Inventor: Min M. Tarng, 1367 Glenmoor Way, San Jose, Calif. 95129

[21] Appl. No.: 461,316

[22] Filed: Jan. 5, 1990

[51] Int. Cl.[5] ..... A47G 19/22

[52] U.S. Cl. ..... 220/258; 220/710; 215/1 A

[58] Field of Search ..... 220/258, 85 SP, 229, 220/90.2, 90.4; 215/1 A; 206/222, 221

[56] References Cited

U.S. PATENT DOCUMENTS

| | | | |
|---|---|---|---|
| 1,545,859 | 7/1925 | Snook | 220/258 |
| 2,171,094 | 8/1939 | Livoti | 220/85 SP |
| 2,969,161 | 1/1961 | McCulloch | 220/258 |
| 3,840,153 | 10/1974 | Devlin | 215/1 A |
| 4,152,378 | 5/1979 | Vcelka et al. | 220/258 |
| 4,291,814 | 9/1981 | Conn | 215/229 |
| 4,359,169 | 11/1982 | Helms et al. | 220/258 |
| 4,407,425 | 10/1983 | Combs | 220/85 SP |
| 4,473,168 | 9/1984 | Cox | 220/258 |
| 4,485,963 | 12/1984 | Panicci | 215/1 A |
| 4,513,889 | 4/1985 | Beard | 220/258 |
| 4,560,081 | 12/1985 | Adams | 220/85 SP |
| 4,579,257 | 4/1986 | Brandlein | 220/85 SP |
| 4,598,837 | 7/1986 | Kreiseder et al. | 220/258 |
| 4,610,374 | 9/1986 | Buehler | 206/222 |
| 4,648,532 | 3/1987 | Green | 206/220 |
| 4,752,016 | 6/1988 | Eads | 220/258 |
| 4,887,712 | 12/1989 | Wells | 220/258 |
| 4,898,293 | 2/1990 | Morel | 208/222 |

*Primary Examiner*—Joseph Man-Fu Moy

[57] ABSTRACT

A drink cap comprising sliding/rotating straw/spout with or without the coolant and/or ice cube houses. There is a conduit inside the sliding/rotating straw/spout to guide the beverage to flow out. The drinker sips the beverage out of the can or bottle through the sliding/rotating straw/spout. The coolant/ice cube houses keep the drink at low temperature for hours.

A drink can comprising sliding/rotating straw/spout and can. The drinker sips the beverage out of the can or bottle through the sliding/rotating straw/spout. The can is vacumn sealed with knotched panel. As the sliding spout is pushed or the rotating straw is pulled, the knotched panel is pushed to open an orifice and the drink may flow out. The drinker sips the drink directly through the sliding/rotating straw/spout. As the sliding spout or rotating straw is pushed to close, the beverage is sealed to preserve the aeration and fragrance.

7 Claims, 7 Drawing Sheets

TANGS DRINKING CAN AND CAP

INTRODUCTION

The drinking cans and bottles used today have the common problems. The can used in market cannot preserve the aeration. After opening the can or cap for a few hours, all the aeration and fragrance escape into the air. The drink becomes sweet water. Besides the canned drink is not easy to carry around. The drink might spread out. The cool drink is warmed up in a few hours. Furthermore, the dirty opening panel is submerged in the beverage. If the drinker drinks the beverage directly, the drinker's lip touches the dirty can and the taste is worse than the taste with the sipping straw. However, it is vexatious to use the straw. The drinker first raises up the tab to open the can. Then the drinker has to find a straw and insert it in the can. The tab is not easy to open. The straw swivels in the can and it is not easy for the drinker's mouth to catch the straw. In such embarrassing environment, the enjoyment of drinks is strictly limited. However, the outdoors activities are much more demanding for the drinks. It is our inventions to provide the enjoyment of the drink in any adverse condition.

My drink cap and drink can may preserve the aeration and fragrance for much longer time. With my drink cap or drink can, the beverage might be carried around. The coolant house and/or ice cube house keep the cool drink at low temperature.

SUMMARY OF THE INVENTION

A drinking can comprises the secure seal and the convenient seal. The secure seal may be the long term permanent open once vacumn seal such as the scotched panel of a can. The scotched panel offers the permanent seal for the beverage. During the service period, the sliding/rotating spout/straw offers the temperary seal for the beverage. It preserves the aeration and fragrancy of the beverage. By pushing or pulling the sliding/rotating spout/straw to squeeze the scotched panels, the can is opened and the beverage is ready to serve. The sliding/rotating straw/spout serves as the pouring spout and/or sipping straw. The drinking cap can be adapted to the common cans or bottles. It has the same functions as the drinking can does.

DESCRIPTION OF THE PREFERRED EMBODIMENTS

Figure 2:
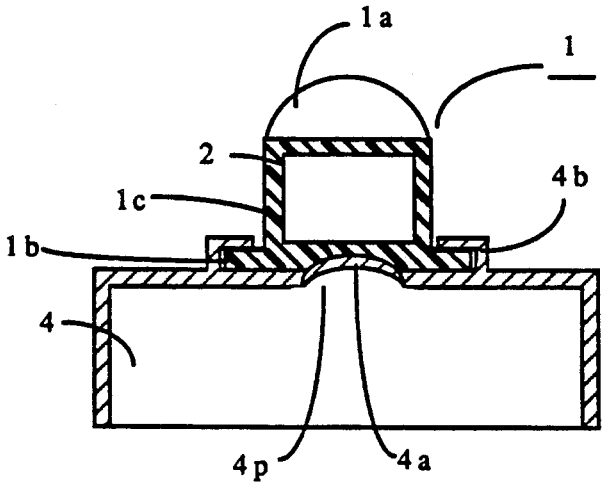
FIG. 2 is the cross-section of the cap with the convenient seal of sliding spout taken at the A—A line in FIG. 1.
Figure 4A:
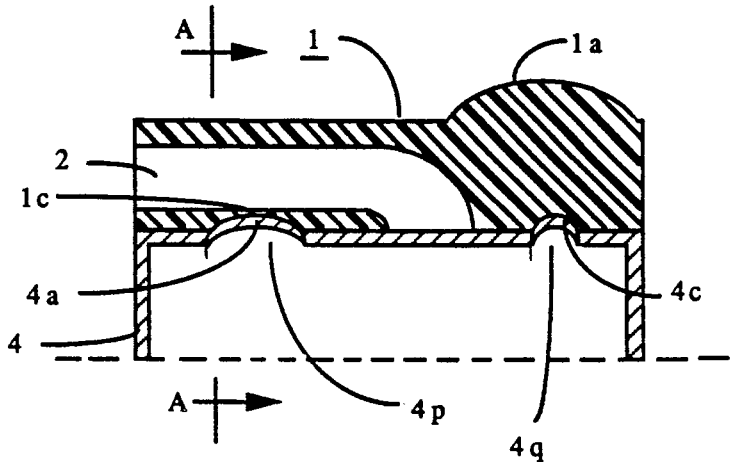
FIG. 4 (A) is the cap with the convenient seal of sliding spout in the unopen position for the noncarbonated beverage; (B) is the cap with the convenient seal of sliding spout in the open position for the noncarbonated beverage; the cap has the pouring aperature with the secure seal.
Figure 3:
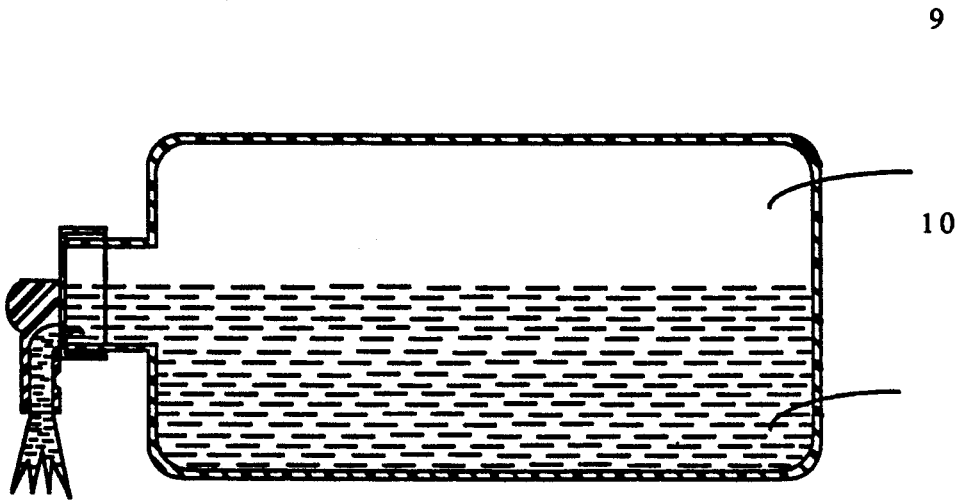
FIG. 3 is the cross-section of the bottle having the cap with the convenient seal of sliding spout in the pouring beverage position.
Figure 5:
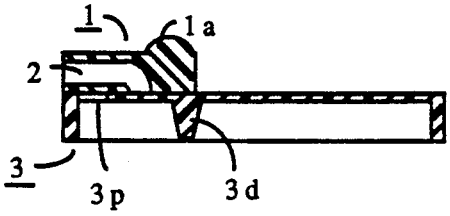
FIG. 5 is the cross-section of the cap with the convenient seal of sliding spout in the closed position; the cap is for the can.
Figure 6:
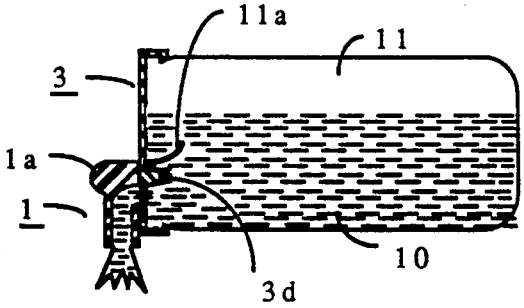
FIG. 6 is the cross section of the can with the convenient seal of sliding spout in the pouring beverage position.
Figure 7:
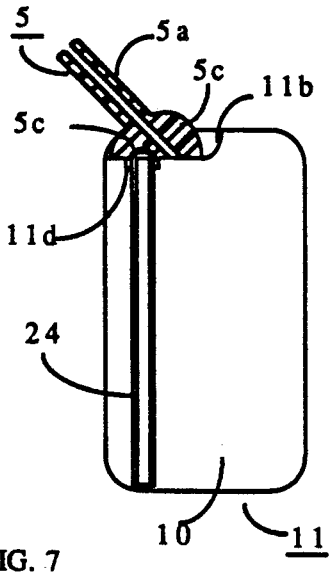
FIG. 7 is the cross section of the can with the convenient seal of sliding straw in the unopen position.
Figure 8:
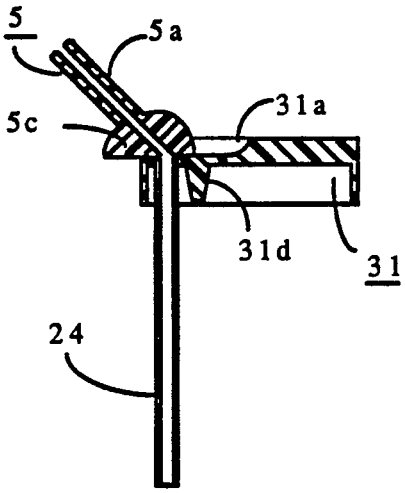
FIG. 8 is the cross section of the cap with the convenient seal of sliding straw in the open position.
Figure 9:
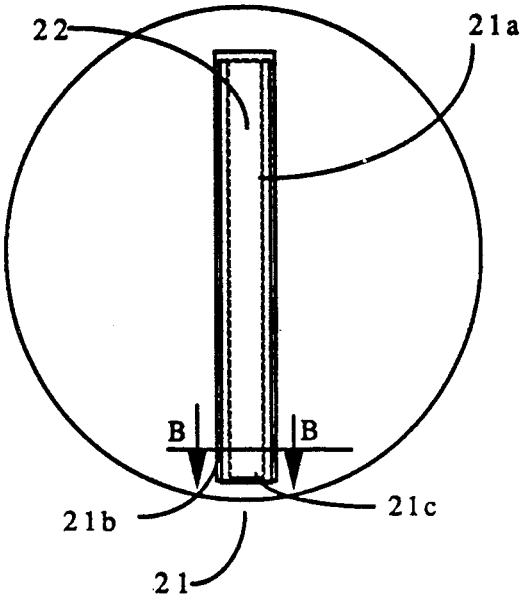
FIG. 9 is the top view of the can with the convenient seal of rotating straw in the closed position.
Figure 10:
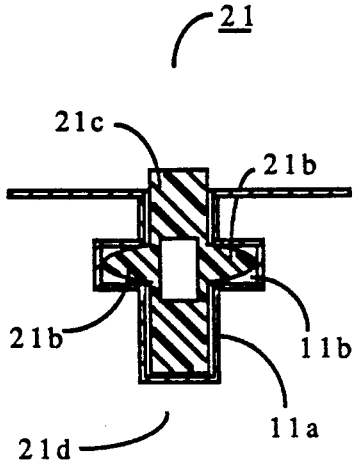
FIG. 10 is the cross section view of the convenient seal of rotating straw taken at B—B line in FIG. 9.
Figure 12A:
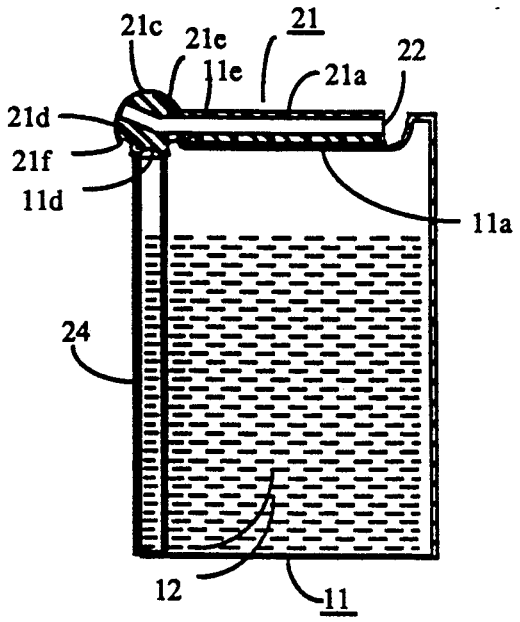
FIG. 12 (A) is the can with the convenient seal of rotating straw of noncarbonated beverage in the unopen position; (B) is the can with the convenient seal of rotating straw of noncarbonated beverage in the sipping position.
Figure 12B:
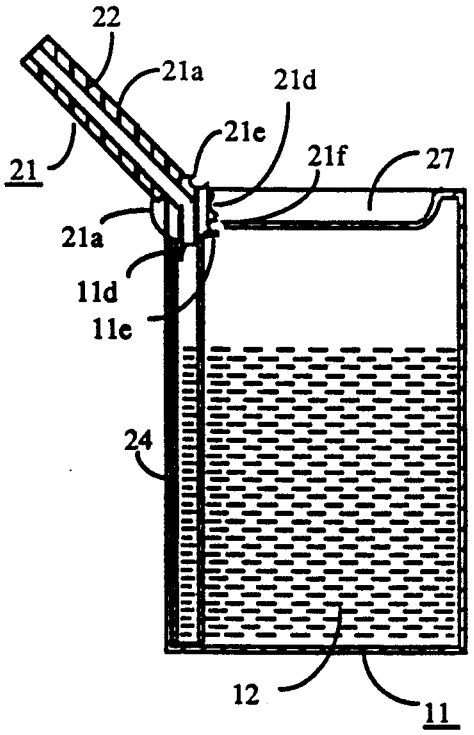
Figure 13A:
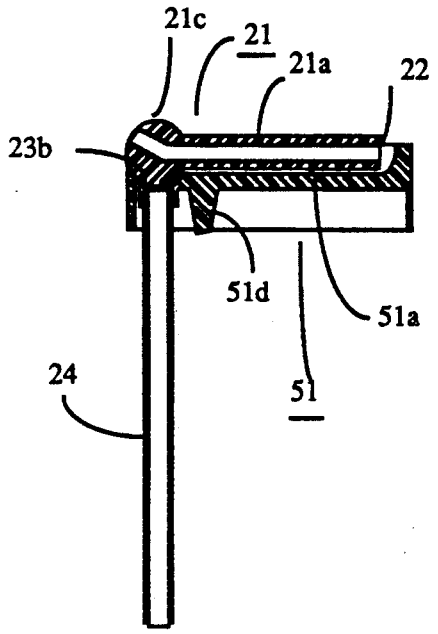
FIG. 13 (A) is the cap of carbonated beverage with the convenient seal of rotating straw in the closed position; (B) is the cap of carbonated beverage with the convenient seal of rotating straw in the sipping position.
Figure 13B:
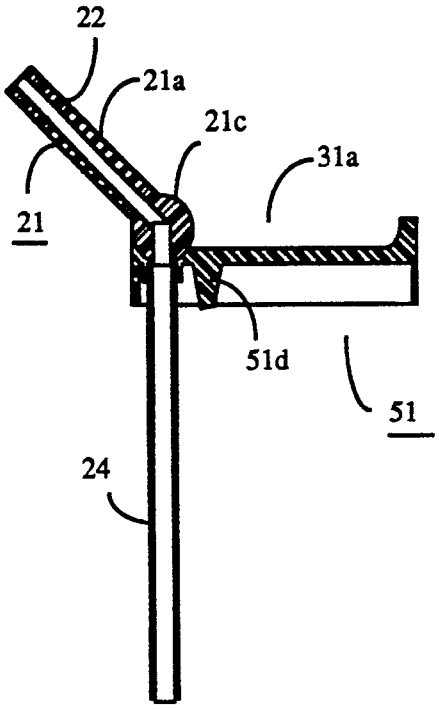
Figure 14:
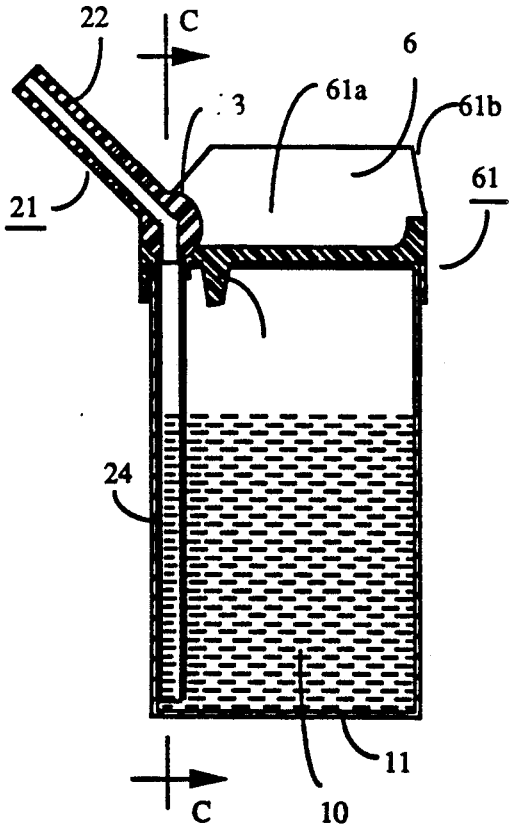
FIG. 14 is the cross section of the cap with the convenient seal of rotating straw having the icy cube and collant houses.
Figure 15:
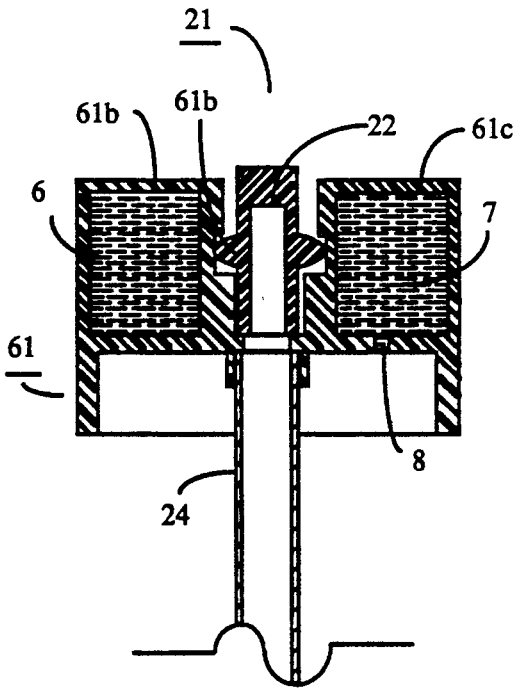
FIG. 15 is the cross section taken at the C—C line in FIG. 14 for the cap having the ice cube and coolant houses.
Figure 16:
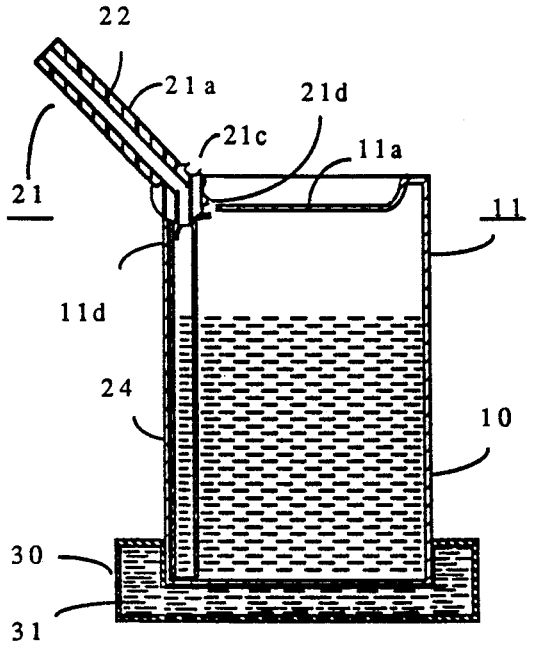
FIG. 16 is the coolant pan/jack for the can.
Figure 17:
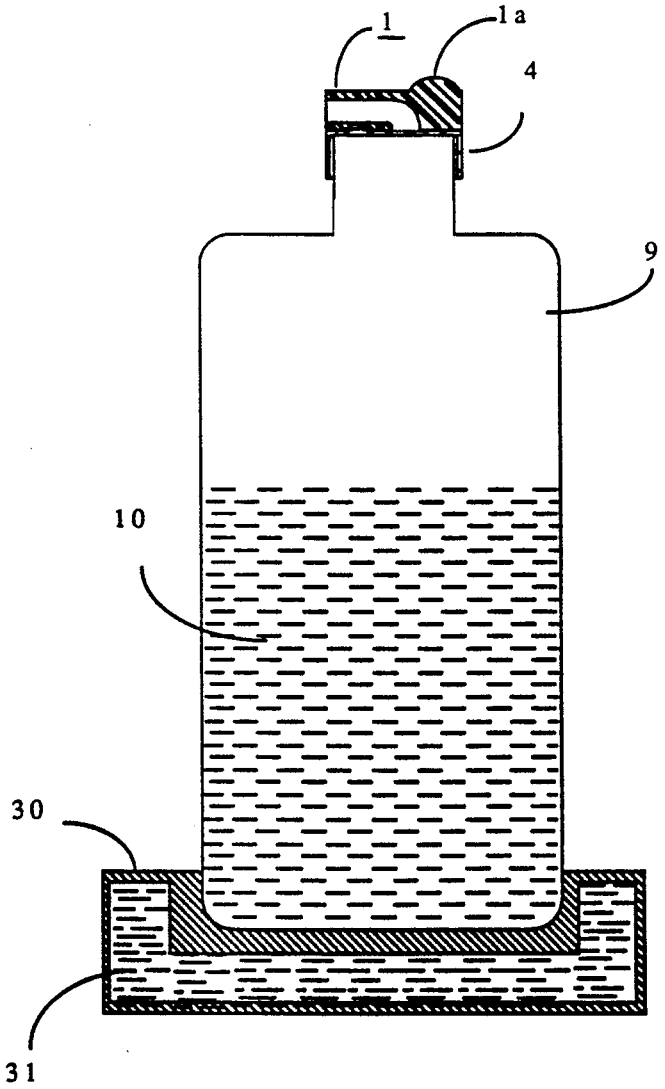
FIG. 17 is the coolant pan/jack for the bottle.

My drink cap and drink can facilitate the opening, sealing and service of the beverage. They preserve the beverage in the best service conditions. The convenient seal of sliding/rotating spout/straw keeps the fragrancy and aeration of beverage. The coolant and/or ice cube houses keep the beverage at low temperature. They enable the beverage to be served in the outdoors athletics. There are several different caps and cans. FIG. 1, FIG. 2 and FIG. 3 show the cap 4 with sliding spout 1. It is designed for the bottle filled with the carbonated beverage. There are two kinds of sealing, the long-term secure sealing and the short term convenient sealing. The long term secure sealing relies on the seal of the scotched panel 4*a*, etc. The scotched panel 4*a* is the open-once seal. As long as the scotched panel 4*a* is opened, it no more has the sealing function. Then the seal relies on the short term convenient sealing of the sliding spout 1. FIG. 4 is the cap 4 for the bottle filled with the non-carbonated beverage. The aeration orifice 4*q* is included in the cap 4. FIG. 5 and FIG. 6 show the cap 3 with the convenient seal of sliding spout 1 for the can 11 filled with the carbonated beverage 10. FIG. 7 is the can 11 having the convenient seal of sliding straw 5 in the unopen position. FIG. 8 is the cap 31 having the convenient seal of sliding straw 5 in the open position. FIG. 9, FIG. 10 and FIG. 11 show the convenient seal of rotating straw for the can filled with carbonated beverage 10. FIG. 12 shows the convenient seal of rotating straw for the can filled with noncarbonated beverage 12. FIG. 13 shows the cap 51 equipped with the convenient seal of rotating straw for the carbonated beverage. FIG. 14 and FIG. 15 show the cap of the convenient seal of rotating straw equipped with the ice cube and/or coolant houses. FIG. 16 is the coolant pan/jack for the can to serve the cool beverage at low temperature. FIG. 17 is the coolant pan/jack for the bottle to serve the cool beverage at low temperature.

Figure 1A:
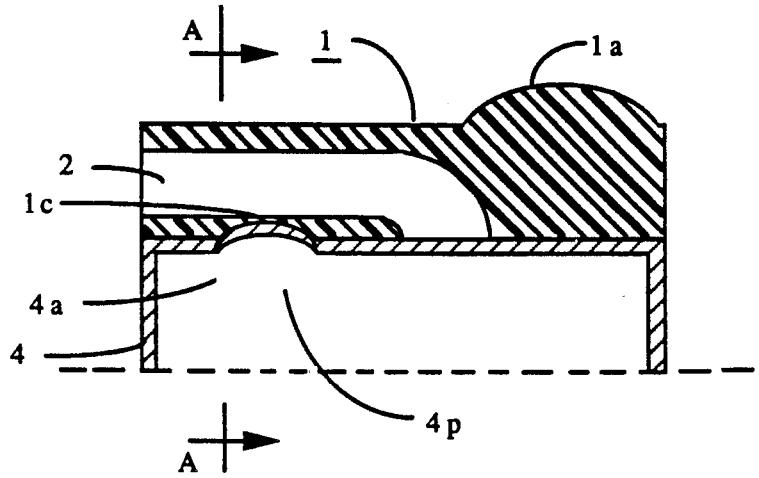
FIG. 1 (A) is the cross-section of the cap with the convenient seal of sliding spout in the unopen position; (B) is the cross-section of the cap with the convenient seal of sliding spout in the open position; the cap is for the bottle and it has the secure seal.
Figure 1B:
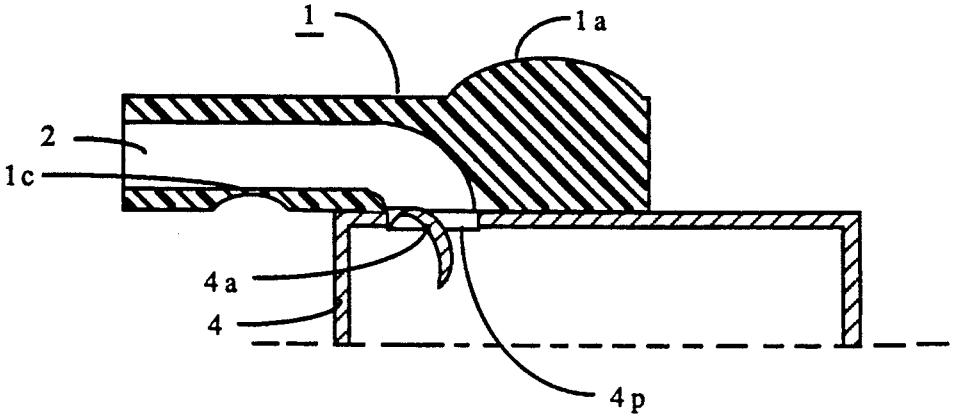

FIG. 1 shows the operation of the cap 4 being equipped with the convenient seal of sliding spout 1. The scotched panel 4*a* fits in the dent 1*c*. As shown in FIG. 2, the flanges 1*b* of the sliding spout 1 is held by the cap collar 4*b*. The cap collar 4*b* and the cap 4 form a slot for the sliding spout 1 to slide. In FIG. 1A, pushing the head 1*a* with the thumb, the convenient seal of sliding spout 1 slides on the cap 4. As the convenient seal of spout 1 slides, the dent 1*c* squeezes the secure seal of scotched panel 4*a* and the aperature 4*p* is opened as shown in FIG. 1B. Just with a single action of pushing the head 1*a*, the aperature 4*a* of cap 4 is opened and the beverage is ready to serve. A little portion of the rim of the secure seal of panel 4*a* is not scotched. So the detached secure seal of panel 4*a* still attaches to the cap 4. To keep the aeration of the carbonated beverage 10, before pushing the head 1*a*, the bottle 9 is tilt first as shown in FIG. 3. After the carbonated beverage 10 covers the aperature 4*p*, the drinker pushes the head 1*a* with thumb. Under the gas pressure in the bottle 9, the beverage 10 flows out of the port 2. After the cup being filled up, the drinker uses the thumb to pull back the head 1*a* to shut off the beverage and then raises up the bottle 9. With these operations, we keep the aeration and fragrance in the bottle 9.

Figure 4B:
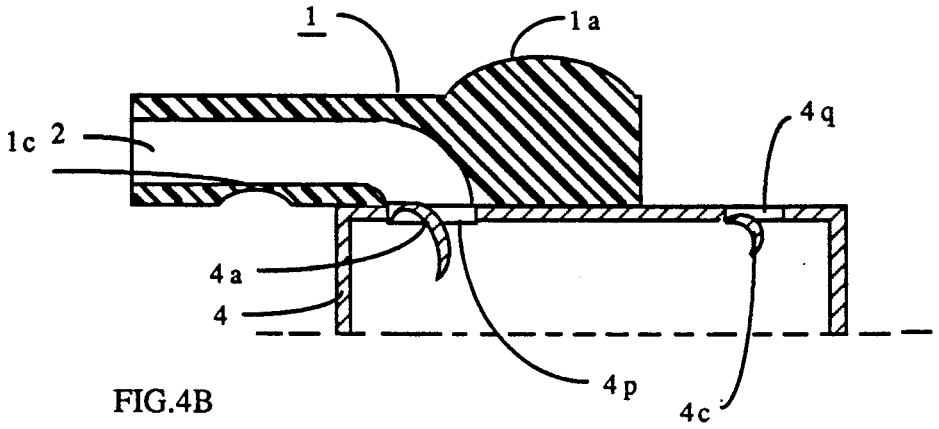

For the noncarbonated beverage, the cap 4 has the vent orifice 4*q* sealed with the secure seal of scotched panel 4*c* as shown in FIG. 4. As the convenient seal of sliding spout 1 slides, both the secure seals of scotched panels 4*a* and 4*c* are gnawed by the convenient seal of sliding spout 1 and forced to open as shown in FIG. 4B. The air comes through the orifice 4*q* as the beverage 10 is poured out of the aperature 4*p*. As the convenient seal of sliding spout 1 is pulled back, the convenient seal of sliding spout 1 seals both aperatures 4*p* and 4*q*.

The sealing mechanism of the convenient seal of sliding spout 1 may be applied to the can cap 3 as shown in FIG. 5 and FIG. 6. The can cap 3 clamps on the top of can 11.

The projection 3*d* punches through the secure seals of scotched panel 11*a* on the top plate of the can 11. In FIG. 6, the drinker uses index finger to push the head 1*a* and pours the beverage 10 out of the port 2. As the cup is filled up, the drinker pulls back the convenient seal of sliding spout 1 to seal the can 11 first and then raises up the can 11. With the short term seal of the convenient seal of sliding spout 1, the aeration can be kept for a long time.

FIG. 7 is the can 11 equipped with the convenient seal of sliding straw 5 in the unopened position. Inside the can 11, there is a straw 24 attached to the rim of the scotched panel 11*d*. The scotched panel 11*d* fits in the dent 5*c*. As the convenient seal of sliding straw 5 is pushed with the index finger, the convenient seal of sliding straw 5 squeezes against the scotched panel 11*d* to open the aperature. FIG. 8 is the can cap 31 equipped with the convenient seal of sliding straw 5 in the open position.

The conduits in the convenient seal of sliding straw 5 and the straw 24 constitute the sipping passage for the beverage.

FIG. 9, FIG. 10 and FIG. 11 show the novel design of the can with the convenient seal of rotating straw 21. The drinker just pulls up the straw 21 attached on the top of the can 11 and the beverage 10 is ready to serve. Due to the long stem 21*a* of the convenient seal of rotating straw 21, the can 11 is very easy to open. The convenient seal of rotating straw 22 doesn't swivel so that it is easy for the drinker's mouth to catch the port 22 of the straw 21. Due to the seal of the head 21*c* of the convenient seal of rotating straw 21, the open area 21*d* is clean. The aeration in the can 11 is preserved so that the taste is always good.

Figure 11A:
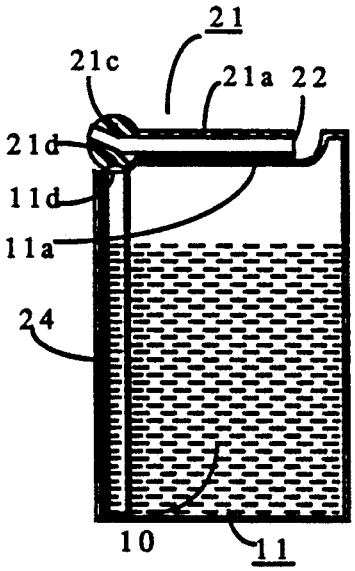
FIG. 11 (A) is the can with the convenient seal of rotating straw of carbonated beverage in the unopen position; (B) is the can with the convenient seal of rotating straw of carbonated beverage in the sipping position.
Figure 11B:
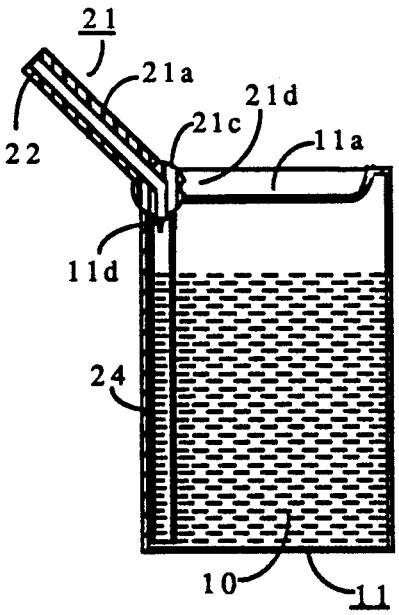

FIG. 9 is the top view of the can in FIG. 11A. The convenient seal of rotating straw 21 fits in the slot 11*a* on the top cover on the can 11. This slot 11*a* may be manufactured with the pressing and/or stamping method. The mandrel 21*b* fits in the cup joint 11*b*. The convenient seal of rotating straw 21 is pivotally supported at the mandrel 21*b*. The scotched panel 11*d* fits in the dent 21*d*. The inner straw 24 attaches to the top cover of the can 11 along the rim of the scotched panel 11*d*. The drinker uses the finger to pull the convenient seal of rotating straw 21 at the port 22 and rotates the straw 21. The outer straw 21*a*, head 21*c* and the inner straw 24 constitute the passage for the beverage 10. The beverage 10 is ready to serve. The dent 21*d* gnaws the scotched panel 11*d* and pushes the panel 11*d* downward as shown in FIG. 11B. The scotched panel 11*d* has tiny portion of the rim not being scotched. As the scotched panel 11*d* is squeezed to open the aperature, the scotched panel 11*d* still attaches to the top cover 11*a*.

For the noncarbonated beverage 12, the convenient seal of rotating straw 21 needs an aeration orifice to balance the air pressure. In FIG. 12, the components of the aeration orifice are the dent 21*e*, scotched panel 11*e* and the dent 21*f*. As the convenient seal of rotaing straw 21 rotates, the dents 21*d* and 21*e* gnaw the scotched panels 11*d* and 11*e*. In FIG. 12B, the scotched panel 11*d* and 11*e* are pushed downward. The conduit for the beverage and the aeration orifice are opened. The aeration orifice is constituted of the dent 21*f* and the rim of the slot 11*a*.

The convenient seal of rotating straw 21 also applies to the can cap. There are the rotating straw can caps for the carbonated beverage and noncarbonated beverage. FIG. 13 shows the rotating straw can cap 51 for the carbonated beverage 10. The rotating straw 21 mounts on the can cap 51. By rotating the upper straw section 21*a*, the rotating head 21*c*, upper straw 21*a* and the bottom straw 24 constitute the conduit 22 for sipping.

To serve the cool drink 10 at low temperature in the sport enviroment, the cap 61 may include an coolant house 61*b* or ice cube house 61*c*. As shown in FIG. 14, the rotating straw can cap 61 includes the coolant house 61*b*. Inside the coolant house is the coolant 6. The coolant 6 has high heat capacity so that it can keep beverage 10 cool for a long time. FIG. 15 is taken at the line C—C in FIG. 14. FIG. 15 shows the composite structure of the convenient seal of rotating straw 21 having the coolant house 61*b* and the ice cube house 61*c*. Beneath the ice cube house 61*c*, there is one slit 8 to let the icy water flow out and mix with the beverage 10 in the can 11. In the static enviroment, the can and bottle may sits in the coolant pan/jack 30 as shown in FIG. 16 and FIG. 17. The coolant pan/jack 30 is filled with the coolant 31.

While present exemplary embodiments of this invention, and methods of practicing the same, have ben illustrated and described, it will be recognized that this invention may be otherwise variously embodied and practiced within the scope of the following claims.

What I claim is:

1. An apparatus for drinking beverage, comprising:

a container to hold the beverage, said container being sealed having a side wall, a bottom wall and a top wall, said top wall having a scotched panel and a groove, said scotched panel being connected with said groove;

an open-end spout being mounted on said top wall and being shifted to break the seal of said container by pressing said scotched panel to open a hole on said top wall, said spout having an opening to fit in the peripheral edge of said hole and forming a path for said beverage to flow out, said hole being sealed by said spout when said spout being shifted back and lying in said groove.

2. An apparatus as defined in claim 1 further comprising a conduit sitting inside the container being connected to the inner surface of said top wall and enclosing said hole, said conduit having an opened bottom adjacent to and spaced from said bottom wall, said spout and said conduit forming a path for said beverage to flow out.

3. An apparatus as defined in claim 1 wherein said spout having a dent underneath to fit with a protrusion on said scotched panel, said spout being slided at first time to break the seal of said container by pressing said protrusion on said scotched panel and opening said hole on said top wall, said hole being sealable by sliding back said spout, said groove being convex with the opening facing up, one end of said spout having an arm locked with said groove and being slidable in said groove.

4. An apparatus as defined in claim 3 wherein said top wall having two scotched panels, said spout having two dents to fit two protrusions on said two scotched panels, said two scotched panels being opened two holes by sliding said spout at first time, one said opening on said spout fitting to one of the two said holes to provide the path for beverage and the other said hole being the aeration orifice, said two holes being sealable by sliding back said spout.

5. An apparatus as defined in claim 1 wherein said spout having a ball-type end with an opening at said end and an arm to be locked to said top wall said spout being rotatable with respect to said arm, when rotating said spout at first time, said ball-type end pressing said scotched panel and opening said hole on said top wall, said opening in the spout fitting to said hole on said top wall to allow said beverage to flow out, said hole on said top wall being sealable by rotating back said spout.

6. An apparatus as defined in claim 5 wherein said top wall having two scotched panels, when rotating said spout, said ball-type end pressing said two scotched panels and opening two holes on said top wall to provide a path for beverage and an aeration orifice, said two holes being sealable by said spout when said spout being rotated back.

7. An apparatus as defined in claim 1 further comprising a cooling pan which being mounted to and outside said container, said cooling pan being filled with coolant to provide chilled beverage.

* * * * *